US010249399B2

(12) United States Patent
Nolen, Jr. et al.

(10) Patent No.: US 10,249,399 B2
(45) Date of Patent: Apr. 2, 2019

(54) PRODUCTION OF ISOTOPES USING HIGH POWER PROTON BEAMS

(71) Applicants: GOMES INVESTMENT, LLC, Naperville, IL (US); UCHICAGO ARGONNE, LLC, Chicago, IL (US)

(72) Inventors: Jerry A. Nolen, Jr., Chicago, IL (US); Itacil C. Gomes, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 172 days.

(21) Appl. No.: 14/949,665

(22) Filed: Nov. 23, 2015

(65) Prior Publication Data

US 2016/0111176 A1 Apr. 21, 2016

Related U.S. Application Data

(62) Division of application No. 13/025,079, filed on Feb. 10, 2011, now Pat. No. 9,202,602.

(60) Provisional application No. 61/303,023, filed on Feb. 10, 2010.

(51) Int. Cl.
*G21G 1/00* (2006.01)
*G21G 1/10* (2006.01)

(52) U.S. Cl.
CPC ..... *G21G 1/001* (2013.01); *G21G 1/10* (2013.01); *G21G 2001/0084* (2013.01); *G21G 2001/0089* (2013.01); *G21G 2001/0094* (2013.01)

(58) Field of Classification Search
CPC ..... G21G 1/00; G21G 1/001; G21G 1/0094; G21G 1/10
See application file for complete search history.

(56) References Cited

U.S. PATENT DOCUMENTS

| | | | |
|---|---|---|---|
| 3,434,809 | A | 3/1969 | Swanson |
| 4,582,667 | A | 4/1986 | Bauer |
| 4,664,869 | A | 5/1987 | Mirzadeh et al. |
| 4,681,727 | A | 7/1987 | Mirzadeh et al. |
| 5,160,656 | A | 11/1992 | Bowmen |
| 5,355,394 | A | 10/1994 | van Geel et al. |
| 5,854,968 | A | 12/1998 | Horwitz et al. |
| 6,293,899 | B1 | 9/2001 | Sioshansi et al. |
| 6,299,666 | B1 | 10/2001 | Apostolidis et al. |

(Continued)

OTHER PUBLICATIONS

Ruth, T. J., Dombsky, M., D'Auria, J.M., and Ward, T.E., "Radiochemistry of Astatine" Office of Scientific and Technical Information, Department of Energy Publication NAS-NS-3064, 1988.*

(Continued)

*Primary Examiner* — Sharon M Davis

(74) *Attorney, Agent, or Firm* — Cherskov Flaynik & Gurda, LLC

(57) ABSTRACT

The invention provides for a method for producing isotopes using a beam of particles from an accelerator, whereby the beam is maintained at between about 70 to 2000 MeV; and contacting a thorium-containing target with the particles. The medically important isotope $^{225}$Ac is produced via the nuclear reaction (p,2p6n), whereby an energetic proton causes the ejection of 2 protons and 6 neutrons from a $^{232}$Th target nucleus. Another medically important isotope $^{213}$Bi is then available as a decay product. The production of highly purified $^{211}$At is also provided.

11 Claims, 4 Drawing Sheets

(56) References Cited

U.S. PATENT DOCUMENTS

| | | | |
|---|---|---|---|
| 6,670,456 | B2 | 12/2003 | Frank |
| 6,680,993 | B2 | 1/2004 | Satz et al. |
| 6,895,064 | B2 | 5/2005 | Ritter |
| 7,056,275 | B2 | 6/2006 | Larsen et al. |
| 7,736,610 | B2 | 6/2010 | Horwitz et al. |
| 2003/0194364 | A1 | 10/2003 | Bond et al. |
| 2006/0072698 | A1 | 4/2006 | Morgenstern et al. |
| 2006/0198772 | A1 | 9/2006 | Abbas et al. |
| 2007/0153954 | A1 | 6/2007 | Harfensteller et al. |
| 2007/0297554 | A1 | 12/2007 | Lavie et al. |
| 2009/0162278 | A1 | 6/2009 | Ravn et al. |
| 2009/0191122 | A1 | 6/2009 | Moreno Bermudez et al. |
| 2010/0067638 | A1 | 3/2010 | Zhuikov et al. |
| 2011/0268237 | A1 | 11/2011 | Holden et al. |
| 2011/0317795 | A1 | 12/2011 | Zhuikov et al. |

OTHER PUBLICATIONS

Berel et al., "At Astatine" Gmelin Handbook of Inorganic Chemistry, 8th Edition, 1985, Springer-Verlag Berline Heidelberg GmbH. (Year: 1985).*

Mashnik, Gudima, et al., CEM03.03 and LAQGSM03.03 Event Generators for MCNP6, MCNPX, and MARS15 Transport Codes—LA-UR-08-2931, (May 12, 2008).

Aposolidis, et al., "Production of Ac-225 from Th-229 for Targeted a Therapy", Anal. Chem, (2005), vol. 778, No. 19, Oct. 1, 2015, pp. 6288-6291.

Dadachova, et al., "Targeted killing of virally infected cells by radiolabeled antibodies to viral proteins", PLoS med (2006), vol. 33, Issue 11, e427, pp. 2094-2103.

Jongen, Yves, "A Cyclotron driven neutron multiplier for the production of Mo 99", 37th ECPM, Oct. 29, 2009, Groningen, 41 pages.

Zalutsky, Michael et al., "Targeted α-Particle Radiotherapy with 211At-labeled Monoclonal Antibodies", Nucl Med Biol., (2007), October: 34(7), pp. 779-785.

Dadachova, Ekaterina, "Cancer Therapy with Alpha-Emitters Labeled Peptides", Semin Nucl Med., (2010), pp. 204-208, 40, Elsevier Inc.

Gauvin, H. "Reactions (p, 2pxn) of Thorium-232 at 30-120 MeV" Le Journal De Physiquie, 24(11), 1963, pp. 836-838.

Pate, B.D. and Poskanzer, A.M., "Spallation of Uranium and Thorium Nuclei with BeV-Energy Protons" Physical Review 123(2),1961, pp. 647-654.

Lefort, M. et ai, "Nuclear Spallation Reactions Induced in Thorium by Protons of 82 and 150 MeV" Nuclear Physics, 25, 1961, pp. 216-247.

Zhuikov et al., "Production of Ac-225 and Ra-223 by Irradiation of Th with Accelerated Protons" Radiochemistry, 53 (1),2011, pp. 73-80.

* cited by examiner

PRODUCTION OF ISOTOPES USING HIGH POWER PROTON BEAMS

PRIORITY CLAIM

This Utility Patent Application claims priority benefit as a Divisional of U.S. Non-Provisional Application Ser. No. 13/025,079, filed on Feb. 10, 2011, presently pending, which in turn claims priority benefit as a Non-Provisional Application of U.S. Provisional Application No. 61/303,023 filed on Feb. 10, 2010, the entirety of both Applications incorporated herein.

CONTRACTUAL ORIGIN OF THE INVENTION

The U.S. Government has rights in this invention pursuant to Contract No. DE-ACO2-06CH11357 between the United States Government and UChicago Argonne, LLC representing Argonne National Laboratory.

BACKGROUND OF THE INVENTION

1. Field of the Invention

The present invention relates to a process for producing isotopes, and more specifically, the present invention relates to a process for producing isotopes via nuclear reactions with an accelerator beam on various targets.

2. Background of the Invention

The alpha-emitting radioisotopes $^{225}$Ac (Actinium) and $^{213}$Bi (Bismuth) are being used in clinical trials for cancer therapy. Presently $^{225}$Ac is made available only via processing of materials irradiated for years in reactors. For example, the actinium isotope is a product of decay of $^{229}$Th, which in turn is produced via decay of $^{233}$U, which in turn is produced via neutron irradiation of $^{232}$Th. The isotope $^{213}$Bi is a product of the decay of $^{225}$Ac.

Potential feedstock for the actinium isotope includes approximately 27,000 kilograms (kg) of irradiated light water breeder reactor (LWBR) fuel, which requires processing. If the entire mass of this large volume of LWBR fuel is processed, 5,000 millicuries (mCi), or 5 Ci of $^{225}$Ac could be produced per month.

$^{225}$Ac can also be produced via cyclotrons or photonuclear methods using $^{226}$Ra as feedstock. $^{226}$Ra is also only available in limited quantities as a byproduct of irradiated reactor fuel.

Currently utilized methods for producing Ac and its associated daughter isotope $^{213}$Bi yield very small quantities, about 500 mCi per year. This limited quantity cannot support the present demand for clinical trials. Indeed, a survey at the 10th International Symposium of the International Isotope Society in 2009 estimated a more than tenfold increase in demand from 2008 to 2012 for $^{225}$Ac for clinical trials alone. If the aforementioned clinical trials are successful, there will be an even much larger demand for these isotopes in the future.

Separately, the National Academy of Sciences has emphasized the need for larger quantities of such isotopes, inasmuch as these cocktails may rapidly become the treatment modality of choice for cancer patients.

The current state-of-art is to extract Th-229 from spent fuel. The presently available supply of $^{225}$Ac from this process at Oak Ridge National Laboratory is about 500 mCi per year. Taking into account all available irradiated material in the U.S., the rate could be increased to about 5 Ci per month by separations from tons of the highly radioactive source material.

In light of the foregoing, currently utilized methods are not a viable long-term solution for the production of the expected large quantities required of therapeutic isotopes.

A need exists in the art for method for producing abundant quantities of short-lived therapeutic isotopes, such as $^{225}$Ac, $^{213}$Bi, and other clinically relevant isotopes. The method should be capable of meeting the anticipated demand for these relevant isotopes and potentially cost less than state-of-the-art production methods. Furthermore, the method should utilize currently available technology.

SUMMARY OF THE INVENTION

An object of the invention is to produce medical isotopes via a method which overcomes many disadvantages of the state-of-the-art protocols.

Another object of the present invention is to implement a high yield system for producing isotopes. A feature of the system is the utilization of an accelerator which operates at beam current levels which produce from tens to hundreds of kilowatts (kW) of beam power. A potential advantage of this system is the simultaneous production of multiple isotopes. Another advantage of this system is the production of 5-10 curies of $^{225}$Ac isotope per day per accelerator.

Still another object of the invention is to use a superconducting continuous beam linac to provide the required beam power to produce high quantities of medical isotopes. A feature of the invention is the bombardment of thorium targets with high power proton beams, thereby increasing the yield of isotopes generated per day. For example, 100 kW of 200 MeV protons produce approximately 10 Curies of $^{225}$Ac per day of irradiation.

Yet another object of the present invention is to provide a method for using protons (between 70 MeV and 8000 MeV) for producing isotopes. A feature of the invention is the application of concentrated proton beams to small targets (less than 1 kilogram, and more typically from 1 to 500 grams, and most preferably between 100 and 200 grams), such that the yield of isotopes produced per proton is enhanced. An advantage of the invention is that the low target mass enables more efficient extraction of the desired isotope.

Briefly, the invention provides for a method for producing large quantities of radio-therapeutic isotopes with an accelerator, the method comprising using a beam of protons, whereby the beam is maintained at between about 70 to 8000 MeV; and irradiating a thorium-containing target with the protons.

Also provided is a method for producing Astatine isotope, the method comprising irradiating a thorium target for a time and at an energy sufficient to produce radon isotopes; extracting the radon isotopes from the target as a gas; purifying the extracted radon isotopes; and separating $^{211}$At from the purified radon isotopes.

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
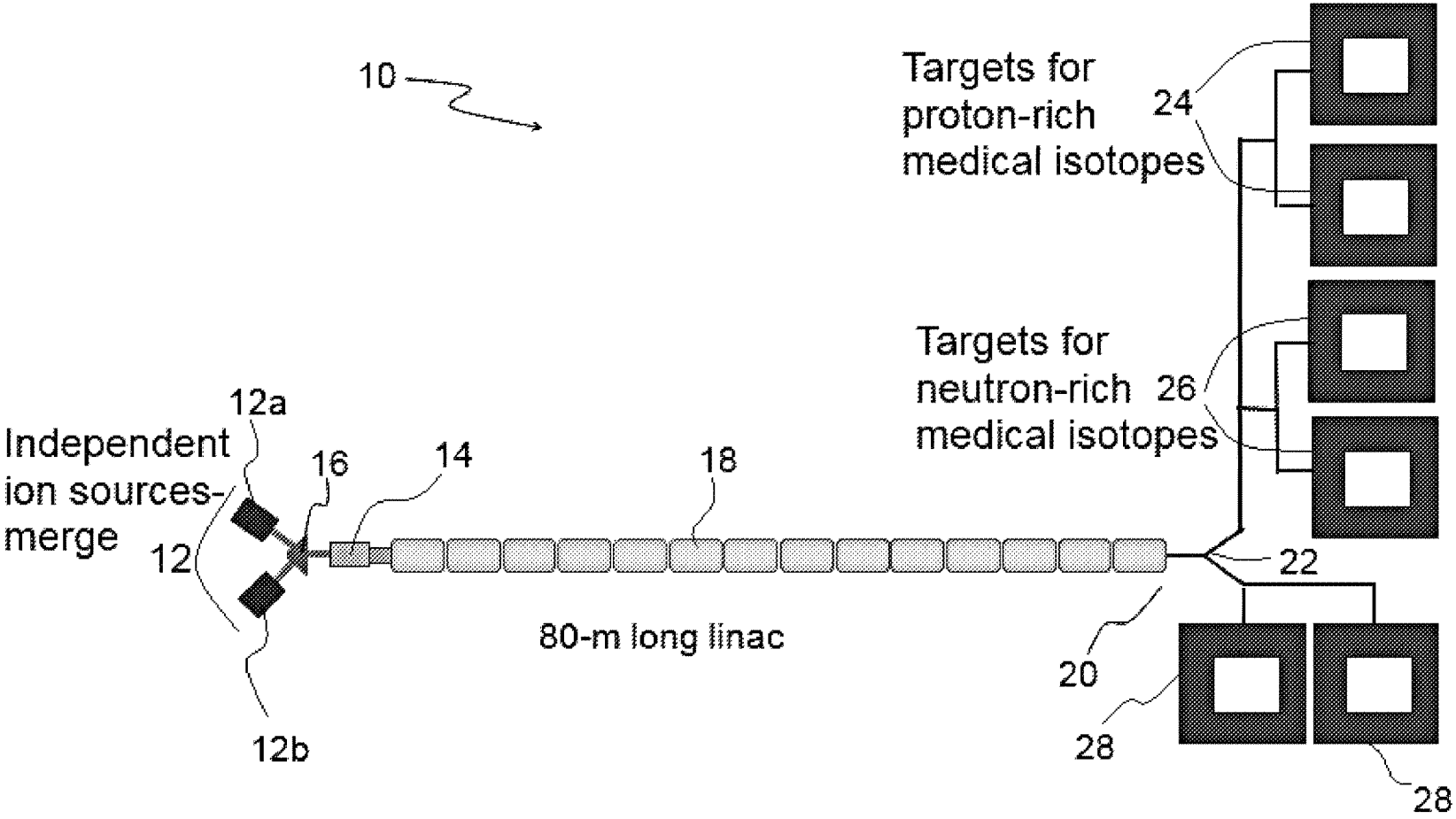
FIG. 1 is a schematic diagram of an accelerator configuration for use the implement isotope production, in accordance with features of the present invention.

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The instant invention is capable of producing large numbers of a single isotope, and/or the simultaneous production of several different isotopes. A salient feature of the system is the bombardment of a specific target, or a plurality of targets, with protons having sufficient energy (between 70 and 8000 MeV) to transmute target atoms to desired isotopes. Superconducting or nonsuperconducting linear accelerators provide the energy and beam current to produce either large quantities of one isotope, or simultaneously produce different isotopes. An advantage of the invented method is that it provides large yields of isotopes of interest, such as $^{211}$At, in continuous mode without relying on dissolving the target to separate the isotopes of interest.

The linac systems utilized in the invented system provide the best option for a medical isotopes production facility. The invented system is operable at current levels of 10 milliamperes or more. These linacs provide 20 times the power of modern cyclotrons at a cost per watt of beam power which is much less that provided by cyclotrons. These linacs provide a medical isotope production capability for both neutron-produced isotopes such as $^{99}$Mo and proton-produced isotopes such as $^{225}$Ac and $^{211}$At.

Pursuant to the relation P=VI (wherein P is the power expressed in watts, V is the electromotive force, expressed in volts, and I is the current expressed in amperes), a superconducting linac permits the use of low power to either produce one or several isotopes very economically by sharing the beam power between many targets simultaneously.

A myriad of isolates can be produced, given specific targets and accelerator beams. For example, an embodiment of the invention provides a way to achieve very high specific activity, for example, with 100 kW of 200 MeV protons, a specific activity of approximately 1 Curie per gram of target material is produced in a 15-day irradiation, this can be compared with the processing of 1.5 metric tons of irradiated reactor fuel to obtain the 50 grams of $^{229}$Th that yields 4.3 Ci $^{225}$Ac per month.

Actinium Isotope

Production Detail

Alpha emitters are ideal for the treatment of malignant tissue. The alpha particles emitted typically have an energy of about 5 MeV and a range of 50 microns so that all of the radiation emitted by the injected isotope with a carrier is confined to the immediate vicinity of the targeted physiologic cells.

$^{225}$Ac offers special advantages: its 10-day half life allows sufficient build up of the isotope in two weeks of linac irradiation. Also, its 10-day half life and the very short half-lives of the daughter isotopes guarantee rapid depletion of the radiation once treatment is effected. Finally, the four alpha particles in the decay chain deliver a total energy of 27.4 MeV at the tumor site with less than 2 MeV of the less-localizable beta radiation being delivered. An embodiment of this invention uses the nuclear reaction $^{232}$Th(p, 2p6n) to produce the isotope $^{225}$Ac via irradiation of thorium targets with proton beams provided by an accelerator. The thorium targets are produced from naturally occurring material in contrast to the man-made isotopes in irradiated reactor fuel which are used in the present state of the art. The isotope is produced at a rate several thousand times what is presently possible. The invented system bombards $^{232}$Th with protons in the energy range from 70 MeV to 2000 MeV, and more typically from 70 MeV to 400 MeV, to produce $^{225}$Ac, 2 protons, and 6 neutrons. Inasmuch as linac costs are directly proportional to beam energies produced (energy expressed in electron-volts), the invention utilizes low cost linacs to product heretofore scarce medical isotopes.

The target comprises thorium metal either in the form of several thin sheets or as a porous structure to enable efficient removal of the deposited beam power by liquid or gas cooling.

With 0.5 milliamperes of 200 MeV protons (100 kW) this isotope is produced at the rate of over 3000 curies per year, as opposed to the approximately 0.5 curies per year that is presently available for clinical trials. At 100 MeV beam energy, about 1500 curies per year can be produced with the same beam power (i.e., 100 kW) by increasing the current. These production rates have been calculated with the computer code MCNPX using the nuclear reaction model CEM. The code is in widespread use and publically available. An embodiment of the code is found in Denise Pelowitz, editor—MCNPX User's Manual—Version 2.6.0, November 2007; and Mashnik, Gudima, et al.—CEM03.03 and LAQGSM03.03 Event Generators for MCNP6, MCNPX, and MARS 15 Transport Codes—LA-UR-08-2931, February 2008, all of which are incorporated by reference.

To separate and purify the $^{225}$Ac isotope from the primary target of $^{232}$Th, first the actinium element is separated chemically. Then, if necessary, the impurity isotopes of actinium, namely $^{227}$Ac, are separated from the $^{225}$Ac via an electromagnetic mass separator. The chemical separation is publicly available. One embodiment for chemical separation is found at Apostolidis et al. Anal. Chem. 77 (2005) 6288.

Often, however, the decay product of the $^{225}$Ac, i.e., $^{213}$Bi, is the most relevant isotope for therapeutic treatment, in which instance physical separation of $^{225}$Ac from other actinium isotopes is not necessary. Rather, a $^{213}$Bi generator is utilized, such as is commercially available from Northstar Radioisotopes, LLC of Madison, Wis. As such, the invented system facilitates production of $^{213}$Bi via harvesting this isotope as a daughter product from $^{225}$Ac.

By these techniques, samples of $^{225}$Ac and/or $^{213}$Bi are obtained in the forms and at the purity levels required for their immediate clinical application.

Astatine Isotope

Production Detail

An embodiment of the invented method is the production and purification of the radio-isotope astatine-211. Radionuclides that decay by the emission of α-particles such as the heavy halogen astatine-211 ($^{211}$At) enable the combination of cell-specific molecular targets with radiation having a range in tissue of only a few cell diameters. The alpha particle continuously loses energy as it travels through the biological matrix and this deposition of energy disrupts cell function or kills the physiologic cells it touches.

Surprisingly and unexpectedly, the inventors found that $^{211}$At is produced in large yields by irradiation of thorium targets with protons of about 100-8000 MeV, preferably from about 100-400 MeV, and most preferably from about 100 to 300 MeV, which are guided along a beam line to strike the target. As disclosed supra, the inventors found that irradiation of a Thorium-232 target directly by about 200 MeV protons creates large numbers of isotopes of radon, francium, radium, and actinium. These isotopes, including Astatine, are produced with an atomic mass number, A, in the range of 197-227.

This observation has prompted another embodiment of the invention, which is the production of Astatine isotope from the decay sequence of Radium ($^{215}$Ra) created by the above invention. In this new embodiment, a cold trap collects $^{211}$Rn, first generated from decay of the $^{215}$Ra. The $^{211}$At is then separated in substantially pure form from precursor $^{211}$Rn. In an embodiment of the separation protocol, the $^{211}$Rn is extracted continuously from a hot, porous thorium production target, since it is produced continuously from the initial product: $^{215}$Ra which decays to $^{211}$Rn with a half-life of only 1.6 msec. The $^{211}$Rn (with a 15 hour half-life) gas can be filtered and collected in a cold trap from which $^{211}$At (7.2 hour half-life) is separated with high purity.

Utilizing the invented method, upon continuously extracting $^{211}$Rn from the target, about 8 Ci per day of the target isotope (e.g. 211At) is generated using a 500 Kw 200 MeV proton beam. More than 100 mCi, and typically about 250 mCi per day of the highly purified 211At is generated using a 15 Kw 200 MeV proton beam.

The same target used to milk the $^{211}$Rn can be, after some days of irradiation, (to be defined based on the isotope of interest), extracted from the beam line and dissolved to separate other isotopes of interest that are not volatile and had stayed in the target material. The temperature of the target is one of the parameters which defines the isotopes that are released and the ones that stay within the target. The temperature of the target is one of the parameters which defines the isotopes that are released and the ones that stay within the target. Isotopes of noble gases, alkalies, and halogens are mobile in the target material and are released at lower temperatures than more refractory or reactive elements. Hence, noble gases such as radon are selectively extracted from production targets.

In summary with this aspect of the invention, the inventors irradiate a porous thorium target with protons generated from a 100-8000 MeV proton accelerator to make $^{211}$At via the decay of Radium ($^{215}$Ra) to Radon gas, which is continuously extracted. (The accelerator may or may not be superconducting.) The radon gas is collected in a cold trap. The trapped $^{211}$Rn decays into $^{211}$At, which is then separated chemically from other Radon isotopes and other decay products of the Radon. The separated $^{211}$At is then converted to chemical forms for use in radioimmunotherapy.

A preferred voltage range for isotope production using the current invention is about 200-400 MeV.

The activity of the 211At will be in secular equilibrium with the $^{211}$Rn in about 24 hours.

Approximately 24 hours of radiation with a 100 kW beam of 200 MeV protons will produce about 4.5 Ci of $^{211}$Rn. In 3 days of irradiation with the same beam, about 6.4 Ci of $^{211}$Rn can be extracted. In 7 days of irradiation, about 6.6 Ci can be extracted.

The method provides extended delivery time for such isotopes as $^{211}$At. The method provides a means to extend the multiplicative effect of the half-life of the isotopes. For example, given the 7-hour half-life of $^{211}$At, that isotope decays to 50% after 7 hours, 25% after 14, and 12.5% at 21 hours. But for the 15-hour half-life of $^{211}$Rn, that isotope is still 12.5% viable after 45 hours (3 half lives). This would be more than 6 half-lives of $^{211}$At, when the decay would have been less than 2% remaining. In summary then, while state of the art methods for production of the isotope compels delivery and patient administration within about 21 hours, or 3 half-lives, the current method provides a means to provide the same remaining fraction after 45 hours since it is determined by the 15 hour half-life of the $^{211}$Rn mother isotope. This is because the method provides a means for producing and purifying $^{211}$At remotely from the accelerated particle beam source.

As noted elsewhere herein, multiple targets and/or separations permit the creation of other medical isotopes by modifying the proton beam energies and using different target materials.

FIG. 1 provides a schematic diagram of the system that can be used to implement the invention, designated as numeral 10. A plurality of particle ion sources 12 are suitable, such ion sources capable of producing ions of any element having an atomic number from 1 to 92. As such, the aforementioned particle ion sources are capable of generating charged ions of hydrogen, which primarily are those ions utilized in this method.

Downstream of the ion sources is a radio frequency quadrupole (RFQ) 14 which serves to accelerate the particles to predetermined velocities and power levels. In an embodiment of the invention, the beams are generated by independent ion sources and merge into an RFQ injector 14 via a switching magnet 16.

Acceleration occurs as the particles pass through an accelerator structure, such as a sleeve, conduit or other passageway 18. The passageway is typically comprised of electrically conductive material, such as copper. In one embodiment of the system, the passage way is a compact superconducting linac for light ions, approximately 80 meters in length. At this length, a 200 MeV system will provide the same amount of power as a 100 MeV system will generate with twice the current. The system as depicted in FIG. 1 enables either economical production of specific isotopes at lower current, or simultaneous production of several different isotopes using full current setting.

A distal end 20 of the linac terminates in a means 22 for directing the accelerated particles to a plurality of targets 24, 26, 28. Exemplary directing means 22 includes a plurality of magnets, and RF switching mechanisms.

The accelerated particles directly impact or otherwise interact with the target substrates at energies sufficient to transmute the elements comprising the substrate. In one embodiment of the invention, thorium targets are irradiated with protons. A fraction of the protons cause a nuclear reaction such that 2 protons and 6 neutrons are ejected from the target, resulting in the production of atoms of $^{225}$Ac.

Once bombarded (i.e., after irradiation), the targets are removed from the linac environment and subjected to chemical processing so as to isolate the isotopes of interest. The chemical separation of the elements is publicly available and well known by professionals familiar with the art. Also, there are commercial products such as the DOWEX resins from Dow Chemical specifically designed to separate actinium in aqueous solution, per that manufacturer's instructions. Also, INL (Idaho National Laboratory) technology, including MATT (Medical Actinium Therapeutic Treatment Technology) readily extracts actinium and radium from thorium and uranium with the required degree of purity. The further extraction of $^{213}$Bi from actinium can be made using bismuth generators, such as the one available commercially from NorthStar Radioisotopes LLC.

A myriad of target substrates are suitable, including, but not limited to ThC, Thorium metal, ThO, thorium alloy, and thorium composites. These materials are widely available, and their chemistry and processing are well known by professionals familiar with the art. The thorium target to be used has to withstand the bombardment of protons without losing its physical integrity. Cooling is provided to maintain the target material below its melting temperature.

The isotopes generated with the invented system are for medical applications whereby cancer tumors are locally irradiated with alpha particles from the $^{225}$Ac decay or its daughter $^{213}$Bi, or similarly for the isotope $^{211}$At.

Figure 2:
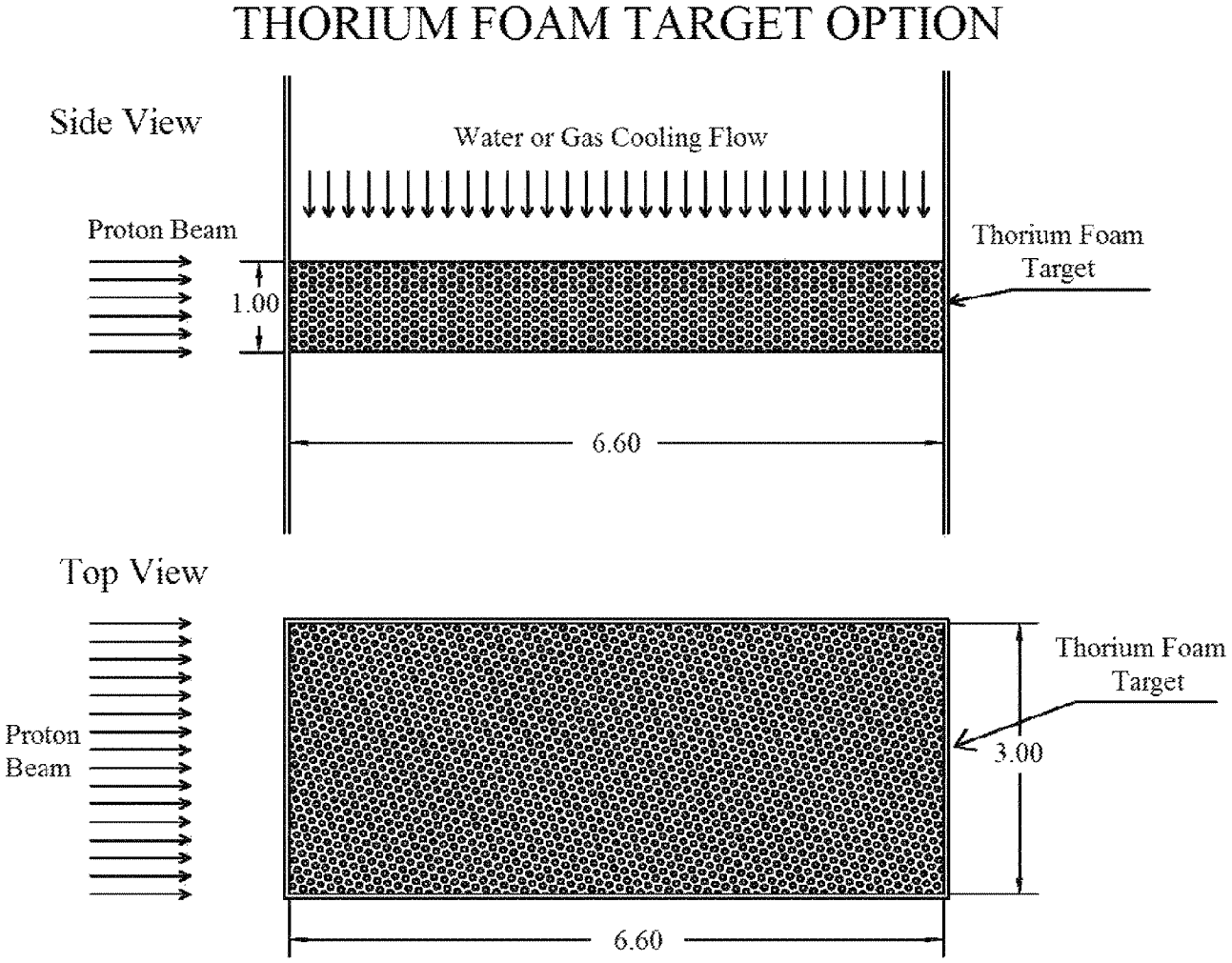
FIG. 2 is a schematic diagram of a target in foam configuration, in accordance with features of the present invention.
Figure 3:
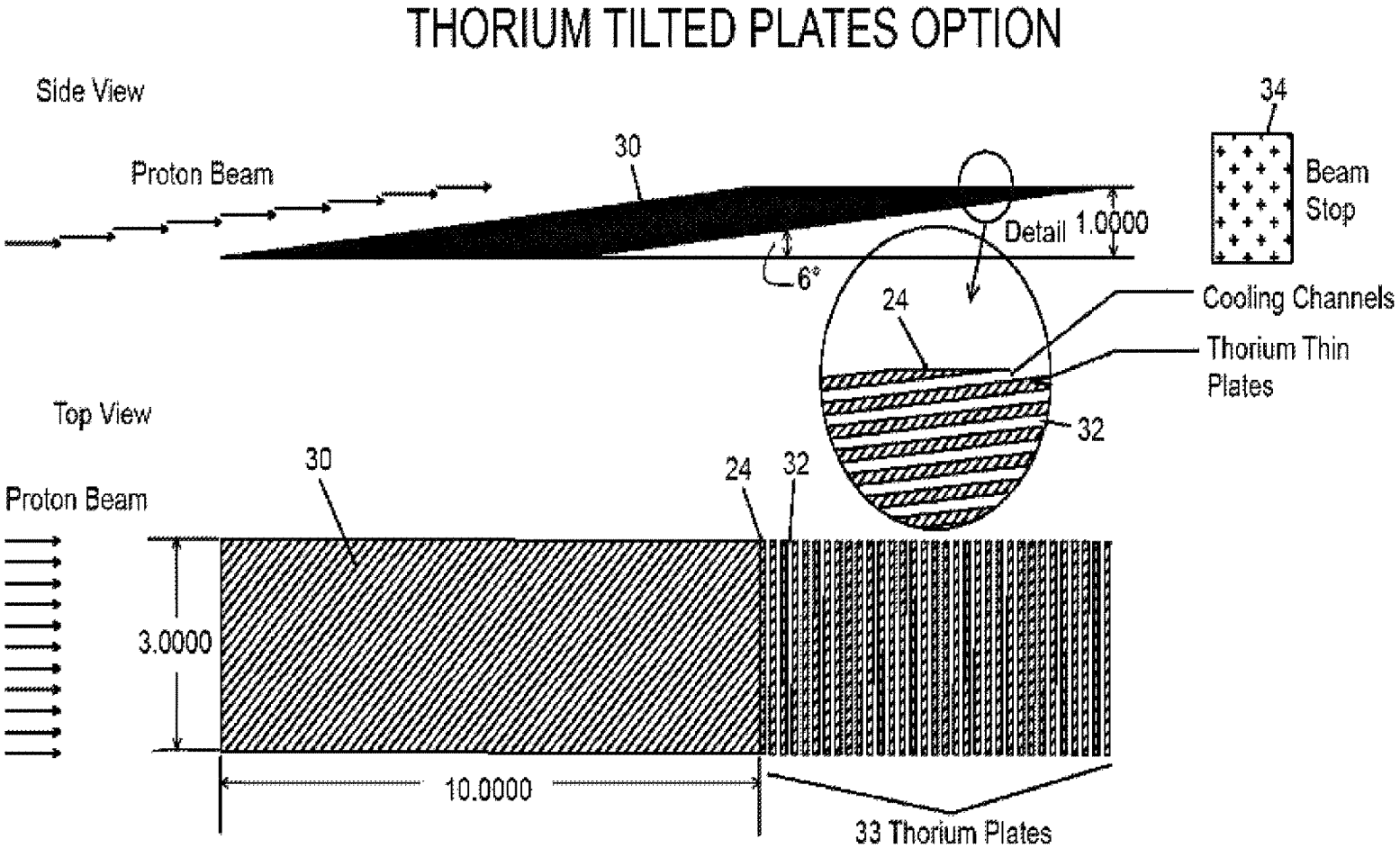
FIG. 3 is a schematic diagram of a target in tile configuration, in accordance with features of the present invention.
Figure 4:
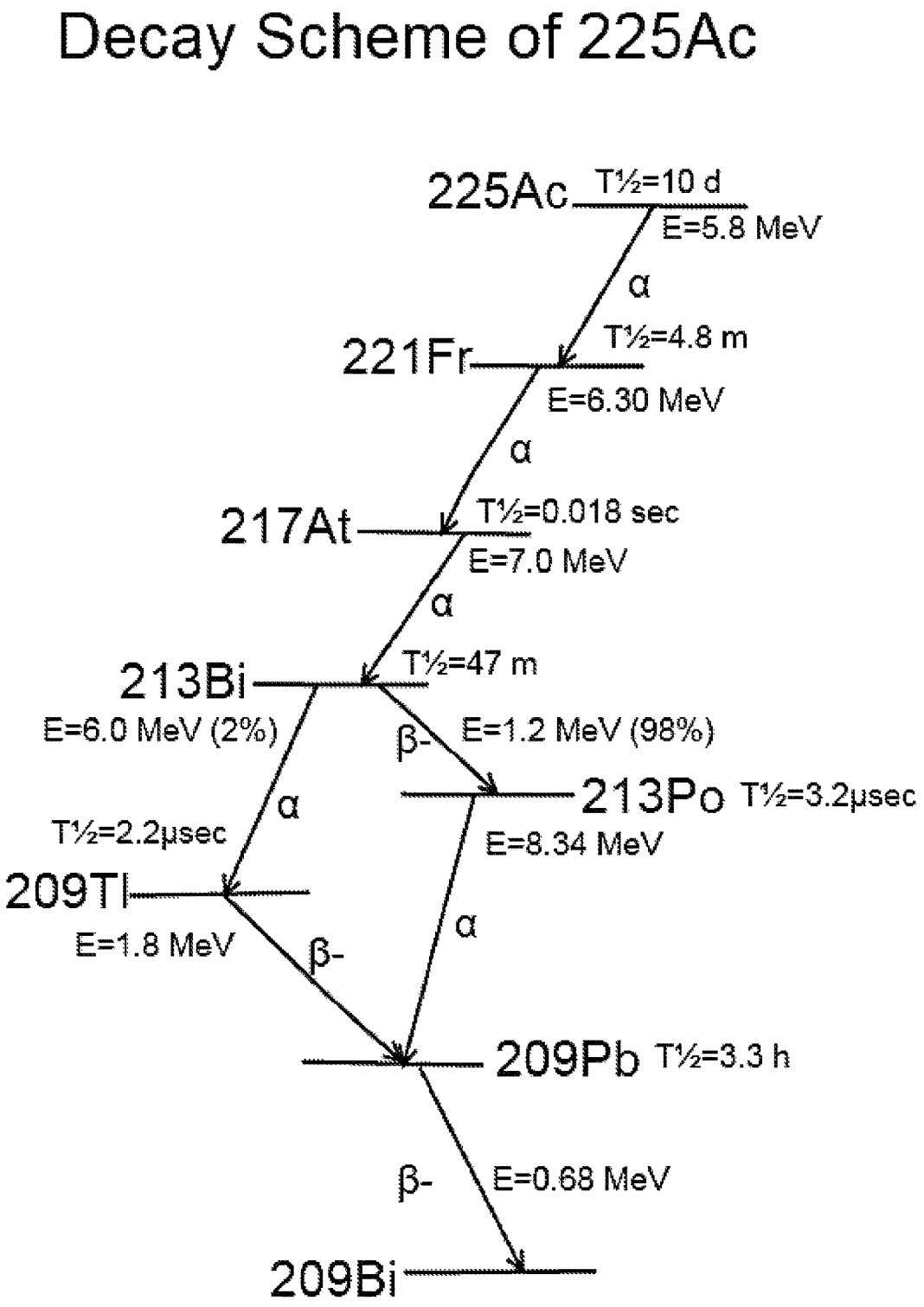
FIG. 4 is a schematic diagram of the decay series initiated by $^{225}$Ac.

FIGS. 2 and 3 are schematic diagrams of exemplary target configurations for use in the invented system. A target 24, or plurality of targets, is arranged such that targets made of a thorium foam or thin plates can be used at those locations. Targets made of thorium foam are similar to the schematic representation in FIG. 2. The target material is about 50 percent interconnected pores, which can be fabricated with known technology used in aerospace, heat exchangers, and other applications.

Alternatively, thorium targets can be made of thin plates similar to the schematic representation in FIG. 3. In one embodiment of the invention, the thorium plates are made in sub-millimeter thickness and stacked at a tilted angle of 5 degrees from the horizontal planes. The plates are spaced by sub-millimeter wide cooling channels defined by placing spacers between the plates.

In the arrangement shown, a plurality of targets is arranged such that the impingement surfaces of each of said targets are approximately parallel to each other, the surfaces arranged at an angle T, to any incoming proton path. An angle greater than 0 and less than 180 degrees is suitable, with an angle greater than 0 and less than 10 degrees being preferable. Most preferable is an angle greater than 4 degrees and less than 7 degrees.

Positioned in close spatial relationship to the targets is a heat sink for drawing heat from the target substrate during proton bombardment. One suitable heat sink is a fluid 32 which contacts the surfaces of the target, the fluid being either a gas or a liquid. An exemplary heat sink is a fluid selected from the group consisting of liquid water, helium gas, liquid metal and combinations thereof. FIGS. 2 and 3 shows the heat sink interlineated with a plurality of target surfaces.

Downstream of the targets is positioned a proton-impervious beam stop 34.

A salient feature of the invention is that the cross section of the target is sized close to the cross section of the incoming proton beam, so as to maximize interaction of more of the target to the beam. FIG. 2 depicts hex hatching in a centrally disposed region of the target which is substantially the same as the cross section of the incoming proton beam. Those centrally disposed regions comprise substantially the entire cross section of the target which opposes the incoming beam.

In operation of one embodiment of the invented system, about 100 grams of Thorium-containing target is bombarded with protons. (The less mass of thorium the better, from a chemical separation standpoint.) After bombardment (usually about 15 days, continuously), at between 70 and 8,000 MeV, the target is removed from the linac and dissolved to harvest the actinium isotope.

While yield of Ci/gram of target material (e.g., thorium) would increase the longer the target is irradiated, other isotopes also are generated during protracted exposure times, thereby complicating the extraction of $^{225}$Ac from the dissolved target. At a given power of 100 kW, and at an energy level of 200 MeV, this embodiment will yield 10 Ci of target actinium per day of linac operation. This yield is realized if the thorium target is removed from the beam line and dissolved after 15 days of irradiation. A 15 day irradiation yields about 1.4 Ci of $^{225}$Ac per gram of $^{232}$Th using approximately 100 grams of thorium target. See Table 1 below for different yields at different power and energy levels. It is appreciated that these power levels and energy levels are chosen for illustrative purposes only and not intended to limit the scope of the isotope production protocol taught herein.

TABLE 1

225Ac yields just after shutdown for 15 days irradiation at 100 kW power.

| Proton Energy (MeV) | Current (mAmps)[1] | Energy Deposited[2] (kW) | Required Target Volume[3] (cm3) | Activity per Target Mass[4] (Ci/g) | Total Activity (Ci) |
|---|---|---|---|---|---|
| 70 | 1.43 | 80. | 19.3 | 0.171 | 19.1 |
| 100 | 1.00 | 80. | 23.3 | 0.342 | 46.5 |
| 200 | 0.50 | 80. | 18.1 | 1.441 | 152. |
| 400 | 0.25 | 56. | 31.4 | 0.365 | 133. |
| 1000 | 0.10 | 36. | 141. | 0.062 | 101. |
| 2000 | 0.05 | 32 | 377. | 0.021 | 91.1 |

[1]Current required to produce 100 kW of beam power.
[2]Energy deposited on the target material (Thorium foam 50% dense). The maximum energy deposition that can be removed by the coolant is ~4 kW/cm$^3$.
[3]Calculated based on the maximum energy deposition that can be removed by the coolant.
[4]The total $^{225}$Ac activity after 15 days of irradiation divided by the mass of thorium in the target.

A salient advantage of the invention is that proton energies between 70 and 2000 MeV can be used to produced these isotopes. At these lower energies, more power is required, but the accelerator is cheaper. At 70 MeV, the invented protocol requires more power, but the accelerator costs are more reasonable, from an industrial production point of view. The invented method allows higher energies to be utilized in existing accelerators where the medical isotopes can be produced as byproducts of the primary accelerator program. Given the invented method, production costs of the 225Ac are much less than that available in the state of the art.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function devoid of further structure.

The embodiment of the invention in which an exclusive property or privilege is claimed is defined as follows:

1. A method for producing astatine isotope, the method comprising:

a. irradiating a target containing $^{232}$Th with a 500 kW, 200 MeV proton beam to produce $^{215}$Ra, wherein the $^{215}$Ra decays into $^{211}$Rn;

b. extracting the $^{211}$Rn from the target;

c. collecting the extraction $^{211}$Rn; and d. generating about 8 Ci of $^{211}$At from the collected $^{211}$Rn per day of irradiation.

2. The method as recited in claim 1 wherein the $^{211}$Rn is continuously extracted from the target.

3. The method of claim 1 wherein the target containing $^{232}$Th comprises a porous thorium target.

4. The method of claim 3 wherein the porous thorium target comprises thorium foam defining about 50 percent interconnected pores.

5. The method of claim 1 wherein the target containing $^{232}$Th incorporates thorium as a thorium material selected from the group consisting of ThC, a thorium metal, ThO, a thorium alloy, a thorium composite, or combinations thereof.

6. The method of claim 1 wherein the target comprises a plurality of thin plates.

7. A method for producing $^{211}$Rn, the method comprising:

a) irradiating a target containing $^{232}$Th with a beam of protons maintained at an energy of about 100 to 400 MeV to produce $^{215}$Ra; and b) generating about 4.5 Ci of $^{211}$Rn in 24 hours of irradiation by allowing the $^{215}$Ra to decay into $^{211}$Rn.

8. The method of claim 7 wherein the target containing $^{232}$Th comprises a porous thorium target.

9. The method of claim 8 wherein the porous thorium target comprises thorium foam defining about 50 percent interconnected pores.

10. The method of claim 7 wherein the target containing $^{232}$Th incorporates thorium as a thorium material selected from the group consisting of ThC, a thorium metal, ThO, a thorium alloy, a thorium composite, or combinations thereof.

11. The method of claim 7 wherein the target comprises a plurality of thin plates.

* * * * *